US010538105B2

(12) United States Patent
Totsuka

(10) Patent No.: US 10,538,105 B2
(45) Date of Patent: Jan. 21, 2020

(54) APPARATUS, METHOD, AND STORAGE MEDIUM

(71) Applicant: CANON KABUSHIKI KAISHA, Tokyo (JP)

(72) Inventor: Atsushi Totsuka, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/012,390

(22) Filed: Jun. 19, 2018

(65) Prior Publication Data

US 2018/0370246 A1 Dec. 27, 2018

(30) Foreign Application Priority Data

Jun. 27, 2017 (JP) ..... 2017-125069
Mar. 8, 2018 (JP) ..... 2018-042442

(51) Int. Cl.
*B41J 2/21* (2006.01)
*B41J 3/407* (2006.01)
*B41J 2/175* (2006.01)

(52) U.S. Cl.
CPC ..... *B41J 2/2132* (2013.01); *B41J 2/17566* (2013.01); *B41J 3/4073* (2013.01); *B41J 2002/17569* (2013.01)

(58) Field of Classification Search
CPC .... B41J 2/2132; B41J 2/2135; B41J 2/17566; B41J 2002/17569; B41J 19/145; B41J 3/4073
See application file for complete search history.

(56) References Cited

U.S. PATENT DOCUMENTS

2006/0269342 A1* 11/2006 Yoshida ..... H04N 1/0473 400/62
2009/0244150 A1* 10/2009 Inoue ..... B41J 2/175 347/14
2014/0354727 A1* 12/2014 Sasayama ..... G06K 15/027 347/15
2016/0305767 A1* 10/2016 Sano ..... B41J 2/2103

FOREIGN PATENT DOCUMENTS

JP 2004-299058 A 10/2004

* cited by examiner

*Primary Examiner* — Sharon A. Polk
(74) *Attorney, Agent, or Firm* — Canon U.S.A., Inc. IP Division

(57) ABSTRACT

An apparatus includes an acquisition unit that acquires first shape data representing a shape of ink unevenness, a first determination unit that determines a direction of a pattern of the ink unevenness based on the first shape data, a second determination unit that determines a rotation angle for changing the direction of the pattern of the ink unevenness based on at least one of a movement direction of a head of a printer and a movement direction of a recording medium, and a generation unit that generates second shape data representing a shape having a pattern in at least one of the movement direction of the head and the movement direction of the recording medium based on the first shape data and the rotation angle.

20 Claims, 12 Drawing Sheets

APPARATUS, METHOD, AND STORAGE MEDIUM

BACKGROUND OF THE INVENTION

Field of the Invention

The aspect of the embodiments relates to an image processing technique of generating data for forming ink unevenness on recording media.

Description of the Related Art

A conventional method for causing an inkjet printer to form unevenness on recording media has been known. Japanese Patent Application Laid-Open No. 2004-299058 discusses a technique of forming unevenness on a recording medium by accumulating ink discharged from a recording head of an inkjet printer on the recording medium.

However, since the discharged ink is wet and spread on the recording medium, there is a case where the target unevenness cannot be formed on the recording medium.

SUMMARY OF THE INVENTION

According to an aspect of the embodiments, an apparatus generates data for an inkjet printer that includes a head having an ink discharge port to form ink unevenness on a recording medium based on relative movement between the head and the recording medium and ink discharge by the head, the apparatus including an acquisition unit configured to acquire first shape data representing a shape of the ink unevenness, a first determination unit configured to determine a direction of a pattern of the ink unevenness based on the first shape data, a second determination unit configured to determine a rotation angle for changing the direction of the pattern of the ink unevenness based on at least one of a movement direction of the head and a movement direction of the recording medium, and a generation unit configured to generate second shape data representing a shape having a pattern in at least one of the movement direction of the head and the movement direction of the recording medium based on the first shape data and the rotation angle.

Further features of the disclosure will become apparent from the following description of exemplary embodiments with reference to the attached drawings.

DESCRIPTION OF THE EMBODIMENTS

<Hardware Configuration of Image Processing Apparatus 1>

Figure 1A:
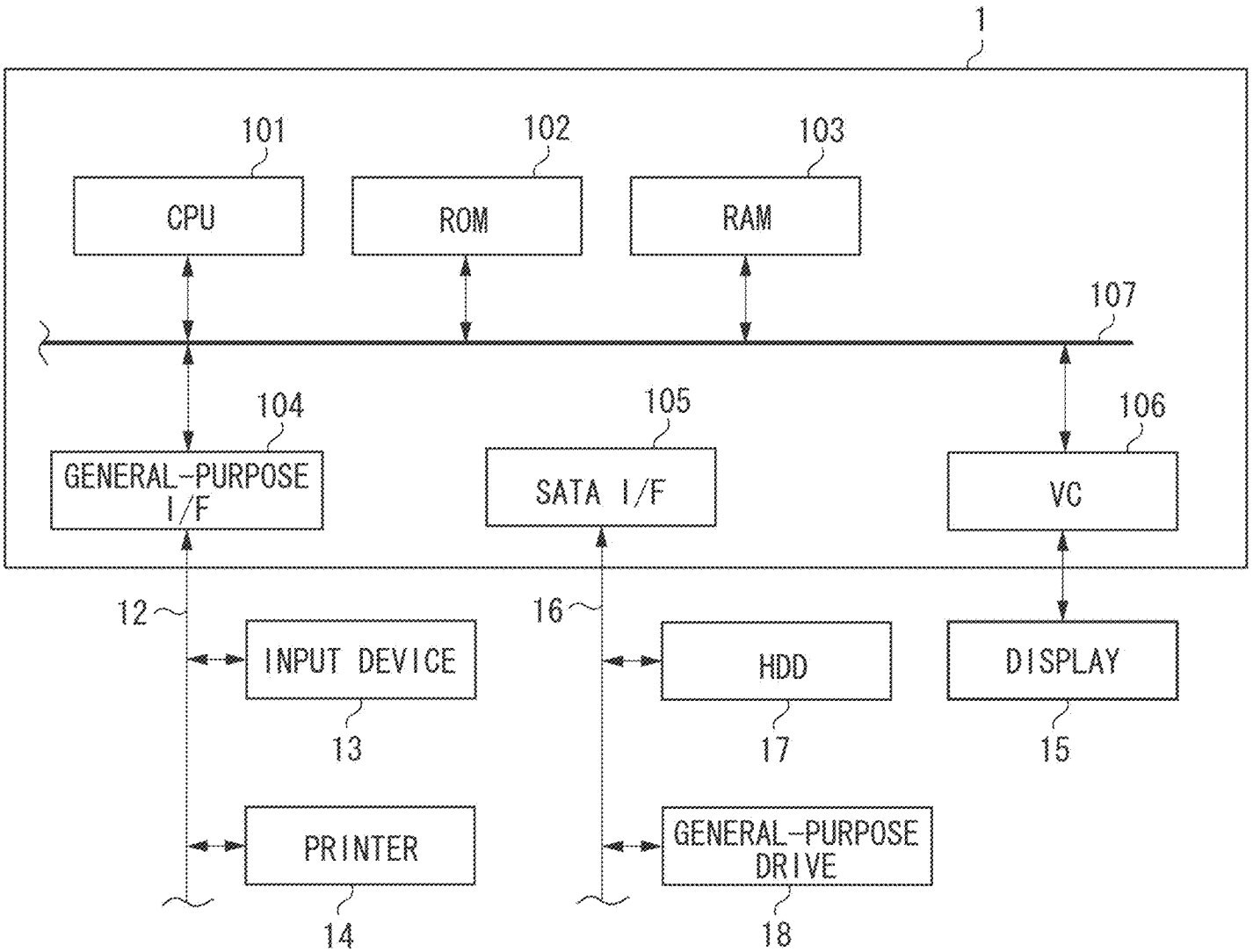
FIGS. 1A and 1B are block diagrams illustrating configurations of an image processing apparatus.

A first exemplary embodiment will be described. FIG. 1A illustrates a hardware configuration example of an image processing apparatus 1. For example, the image processing apparatus 1 is a computer and includes a central processing unit (CPU) 101, a read-only memory (ROM) 102, a random access memory (RAM) 103, a general-purpose interface (I/F) 104, a Serial Advanced Technology Attachment (SATA) I/F 105, and a video card (VC) 106. The CPU 101 executes an operating system (OS) and various kinds of programs stored in the ROM 102, a hard disk drive (HDD) 17, etc., by using the RAM 103 as a work memory. In addition, the CPU 101 controls various components via a system bus 107. The CPU 101 performs the processing described with reference to the following flowcharts, by loading program codes stored in the ROM 102, the HDD 17, etc. to the RAM 103. The general-purpose I/F 104 is connected to an input device 13, such as a mouse or a keyboard, and a printer 14 via a serial bus 12. The SATA I/F 105 is connected to the HDD 17 and a general-purpose drive 18, which reads and writes data on various kinds of recording media, via a serial bus 16. The CPU 101 uses the HDD 17 and various kinds of recording media mounted on the general-purpose drive 18 as storage locations of various kinds of data. The VC 106 is connected to a display 15. The CPU 101 displays a user interface (UI) screen provided by a program on the display and receives input information, which is obtained via the input device 13 and indicates user instructions.

<Configuration of Printer 14>

Figure 2:
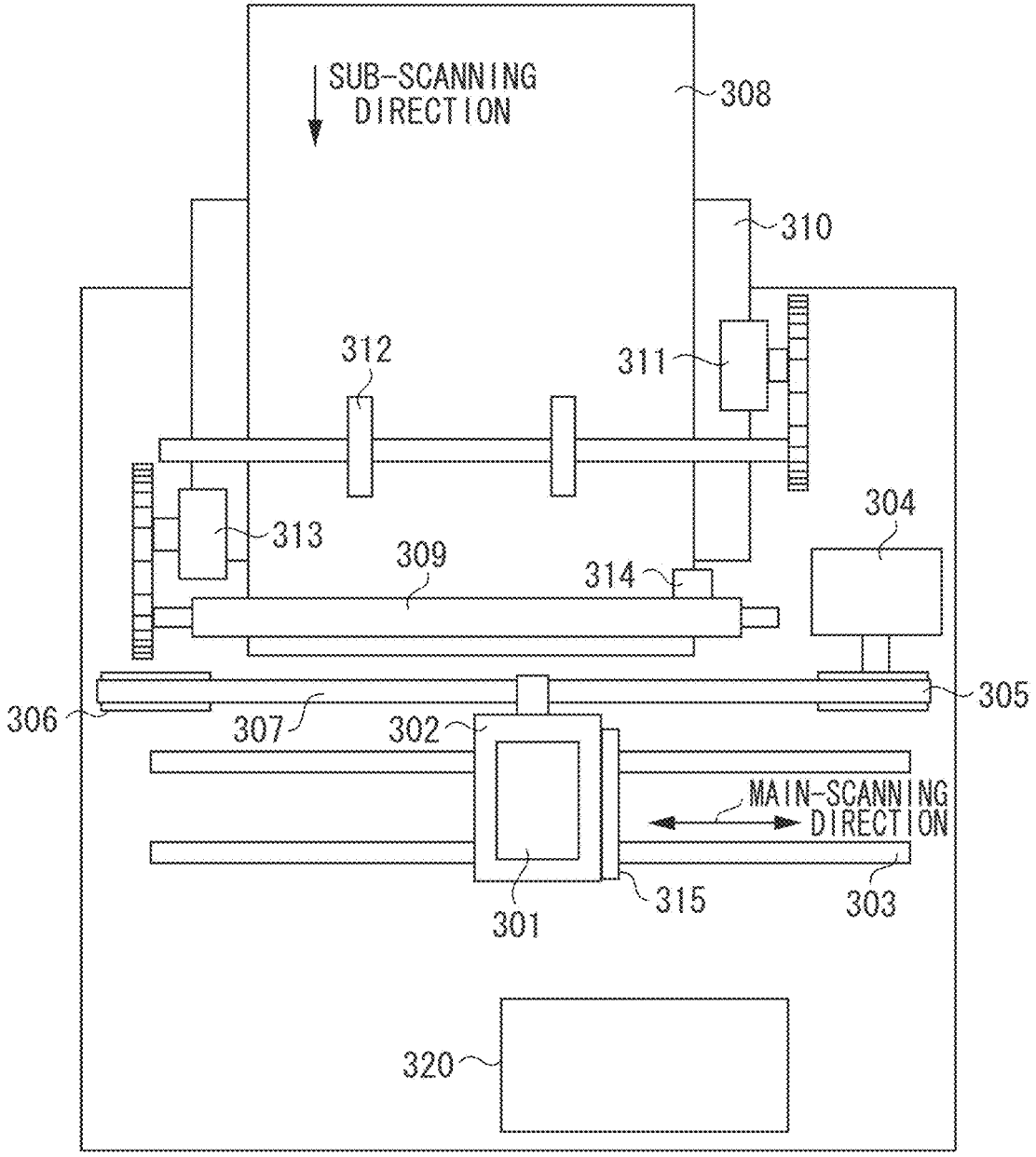
FIG. 2 illustrates a configuration of a printer.

Next, a configuration of the printer 14 will be described with reference to FIG. 2. The printer 14 according to the first exemplary embodiment forms ink unevenness (hereinafter ink unevenness) (an uneven layer) and an image (an image layer) on a recording medium based on data received from the image processing apparatus 1. An unevenness here refers to a pattern of ink formed on the recording medium. An ultraviolet (UV)-curable inkjet printer including ink, which is cured when receiving UV light, is used as the printer 14.

A head cartridge 301 includes a recording head including a plurality of discharge ports, an ink tank supplying the ink to the recording head, and a connector receiving a signal for driving the discharge ports of the recording head. In the ink tank, five kinds of ink are separately provided. More specifically, the ink tank includes clear (CL) ink for forming an uneven layer and four kinds of colored ink of cyan (C), magenta (M), yellow (Y), and black (K) for forming an image layer. These kinds of ink are UV-curable ink, which is cured when receiving UV light. The head cartridge 301 and a UV lamp 315 are replaceably mounted on a carriage 302. The carriage 302 is provided with a connector holder for sending a drive signal or the like to the head cartridge 301 via a connector. The carriage 302 is configured to enable reciprocable movement along a guide shaft 303. More specifically, the carriage 302 uses a main-scanning motor 304 as its drive source and is driven via a drive mechanism formed by a motor pulley 305, a driven pulley 306, a timing belt 307, etc. The position and movement of the carriage 302 are controlled by these components. In the first exemplary embodiment, this movement of the carriage 302 along the guide shaft 303 will be referred to as "main-scanning", and the direction of the movement will be referred to as a "main-scanning direction". Recording media 308 to be printed are placed on an auto sheet feeder (ASF) 310. When an uneven layer or an image layer is formed on a recording medium 308, pick-up rollers 312 are rotated as a sheet feed motor 311 drives. As a result, the recording media 308 are separately fed one by one from the ASF 310. As a conveyance roller 309 rotates, the fed recording medium 308 is conveyed to a recording start position that faces a discharge port surface of the head cartridge 301 on the carriage 302. The conveyance roller 309 uses a line feed motor 313 as its drive source and is driven via a gear. Whether a recording medium 308 has been fed and the position of the recording medium 308 if the recording medium 308 has been fed are determined when the recording medium 308 passes by an end sensor 314. The head cartridge 301 mounted on the carriage 302 is held in such a manner that the discharge port surface protrudes downward from the carriage 302 and is parallel to the fed recording medium 308. A control unit 320 includes a CPU, a storage unit, etc. The control unit 320 receives data from the outside and controls operations of various parts based on the received data. In the first exemplary embodiment, the control unit 320 receives dot arrangement data, which is generated by the image processing apparatus 1 after processing described below and represents dot arrangement of ink.

<Operation of Printer 14 for Forming Uneven Layer and Image Layer>

Next, an operation for forming an uneven layer and an image layer that are performed by the parts to be controlled by the control unit 320 will be described. First, when a recording medium 308 is conveyed to the recording start position to form an uneven layer, the carriage 302 is moved over the recording medium 308 along the guide shaft 303. During the movement, the clear ink is discharged from a discharge port of the recording head. Immediately after the discharge, the UV lamp 315 turns on. Accordingly, the ink is cured. When the carriage 302 reaches an end of the guide shaft 303, the conveyance roller 309 conveys the recording medium 308 by a predetermined amount in a direction perpendicular to the scanning direction of the carriage 302. In the first exemplary embodiment, this conveyance of the recording medium 308 will be referred to as "sheet feed" or "sub-scanning", and the direction of the conveyance will be referred to as a "sheet feed direction" or "sub-scanning direction". When the recording medium 308 has been conveyed by the predetermined amount in the sub-scanning direction, the carriage 302 moves again along the guide shaft 303. By repeating the scanning operation of the carriage 302 using the recording head, the clear ink can be accumulated on the recording medium 308. By alternately performing the accumulation of the clear ink and the sheet feed, unevenness (an uneven layer) is formed on the recording medium 308. After the uneven layer is formed, the conveyance roller 309 returns the recording medium 308 back to the recording start position. Next, in accordance with a process that is the same as that used for forming the uneven layer, UV-curable ink of various colors of cyan, magenta, yellow, and black (CMYK) is discharged on the upper layer of the uneven layer, to form a color image (an image layer). The printer 14 may adopt a different operation and recording method other than the above operation and recording method, as long as an uneven layer and an image layer can be formed on a recording medium. While the first exemplary embodiment uses clear ink as the ink for forming an uneven layer, white ink may be used alternatively.

<Deterioration of Reproduction Accuracy of Printer Regarding Unevenness>

Hereinafter, how the reproduction accuracy of a printer regarding unevenness is deteriorated by the difference between the scanning direction of the head and a direction of a pattern of the unevenness to be formed on a recording medium will be described with reference to FIGS. 3A and 3C. While the pattern of the unevenness to be formed on a recording medium is not particularly limited to a certain pattern, for ease of the description, the following description will be made by using regular parallel lines as an example.

Figure 3A:
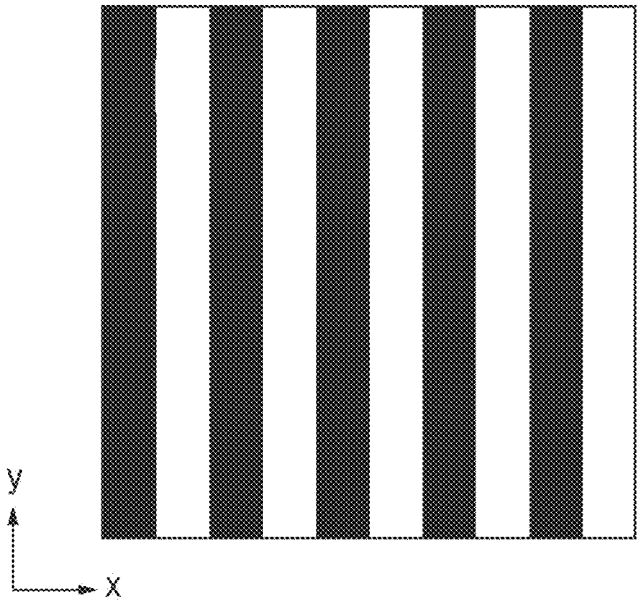
FIGS. 3A and 3C illustrate deterioration of the reproduction accuracy of a printer regarding ink unevenness.
Figure 3B:
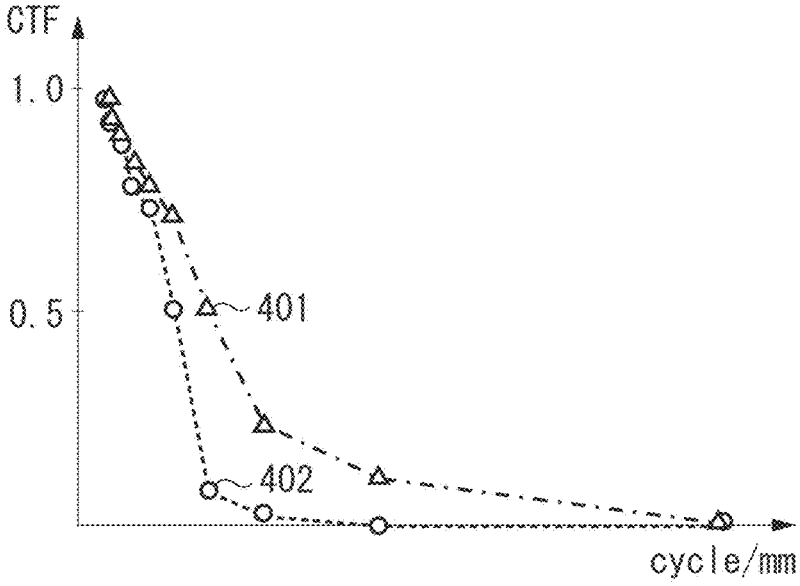
Figure 3C:
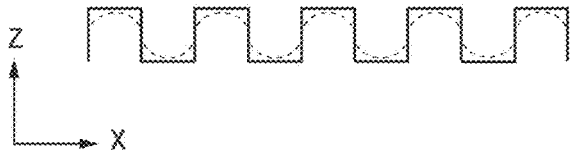

FIGS. 3A and 3C illustrate change of the contrast transfer function (CTF) of unevenness based on a direction of a pattern of the unevenness with respect to the scanning direction of a recording head. FIG. 3A is a diagram illustrating the surface of a recording medium on which ink unevenness has been formed, viewed from directly above. The surface of the recording medium corresponds to an X-Y plane. FIG. 3A illustrates an example of unevenness formed by parallel lines including black areas that represent convex portions and white areas that represent concave portions. FIG. 3B is a graph whose vertical axis represents the CTF of unevenness formed on a recording medium by using a flatbed serial inkjet printer and whose horizontal axis represents the frequency of the unevenness as illustrated in FIG. 3A. The frequency of the unevenness is obtained by assuming that a single concave portion and single convex portion is a wave of a single period. In addition, as to the CTF of the unevenness, a plurality of kinds of unevenness of different frequencies is formed on a recording medium, and a value obtained by dividing a measured value about the height difference between a concave portion and a convex portion of each of the plurality of kinds of unevenness by a theoretical value is used as the CTF. The theoretical value indicates the height difference of the unevenness to be reproduced, and the deterioration of the CTF signifies the deterioration of reproduction accuracy (responsiveness) of the printer regarding the unevenness to be reproduced. In addition, a line 401 represents change of the CTF based on the frequency of the unevenness when the unevenness is formed by orienting the line direction of the parallel line pattern to the main-scanning direction of the printer. A line 402 represents change of the CTF based on the frequency of the unevenness when the unevenness is formed by orienting the line direction of the parallel line pattern to the sub-scanning direction of the printer. FIG. 3C is a cross-sectional view illustrating the parallel line pattern in FIG. 3A. The direction orthogonal to the surface (X-Y plane) of the recording medium is the Z-axis direction. The solid line is an example of ink unevenness that corresponds to a theoretical value. The dashed line is an example of ink unevenness that corresponds to a measured value. As illustrated in FIG. 3C, the ink unevenness indicated by the dashed line is less in CTF than the ink unevenness indicated by the solid line.

It is seen from FIG. 3B that the reproduction accuracy of the printer regarding the unevenness differs mainly in the high-frequency band between the case (the line 402) where the line direction of the parallel line pattern is oriented to the sub-scanning direction of the printer and the case (the line 401) where the line direction of the parallel line pattern is oriented to the main-scanning direction. This depends on the degree of deviation of the ink landing position in a direction. In the case of a serial inkjet printer, the deviation of the ink landing position in the main-scanning direction is attributable to deviation of the ink discharge timing, and the deviation of the ink landing position in the sub-scanning direction is attributable to the conveyance error of the recording medium. When the line direction of the parallel line pattern is oriented to the sub-scanning direction of the printer (the line 402), even if the ink landing position is deviated in the sub-scanning direction, the CTF is not significantly affected. However, if the ink landing position is deviated in the main-scanning direction, the CTF is significantly affected. In contrast, when the line direction of the parallel line pattern is oriented to the main-scanning direction of the printer (the line 401), even if the ink landing position is deviated in the main-scanning direction, the CTF is not significantly affected. However, if the ink landing position is deviated in the sub-scanning direction, the CTF is significantly affected. A flatbed printer is used as the printer used to obtain the graph illustrated in FIG. 3B. Since a flatbed printer does not use rollers to convey recording media, the deviation of the ink landing position in the sub-scanning direction is smaller, compared with other printers. However, to form unevenness, the flatbed printer moves its recording head in the main-scanning direction to accumulate ink in a single area. Thus, the flatbed printer is more affected by the deviation of the ink landing position in the main-scanning direction, compared with general image formation. Thus, as described above, when the impact caused by the deviation of the ink landing position in the main-scanning direction is larger than the impact caused by the deviation of the ink landing position in the sub-scanning direction, orienting the line direction of the parallel line pattern to the main-scanning direction improves the reproduction accuracy of the printer regarding the unevenness. In particular, since unevenness is to be finely formed in the high-frequency band, the deviation of the ink landing position significantly affects the CTF.

Generally, the deterioration of the reproduction accuracy of the printer becomes particularly significant when the line direction of the parallel line pattern is oriented to a direction different from the main-scanning direction and the sub-scanning direction (the direction will be referred to as a diagonal direction). When the line direction of the parallel line pattern is oriented to the diagonal direction, both the deviations of the ink landing position in the main-scanning direction and the sub-scanning direction affect the reproduction accuracy. In addition, in an image in which parallel lines in the diagonal direction are rasterized, an area where neighboring convex portions are close to each other is locally created by jaggies. Thus, when unevenness is formed based on the image, ink drops of convex portions are more easily coupled, compared with parallel lines in the scanning direction. When the diagonal line has an angle closer to the main-scanning direction or the sub-scanning direction, an area where neighboring convex portions are close to each other is less frequently created. Thus, generally, the closer the angle of the diagonal direction is to the main-scanning direction or the sub-scanning direction, the better the CTF will be.

As described above, when unevenness is formed by using a printer, the reproduction accuracy of the printer deteriorates depending on the difference between a direction of a pattern of the unevenness and the scanning direction. As a result, intended texture cannot be reproduced on a recording medium. The deterioration of the reproduction accuracy of the printer regarding the unevenness is not an issue only for a printer such as the printer 14 that forms unevenness by movement of its recording head and the sheet feed. Any printer that controls relative movement between its recording head and a recording medium has the same issue. For example, a printer that forms unevenness by causing a fixed head to discharge ink while moving, separately from the sheet feed, a recording medium in a direction perpendicular to the direction of the sheet feed has the same issue. In addition, a printer that forms unevenness by moving its recording head having the same width as a recording medium instead of performing sheet feed also has the same issue. Hereinafter, including the "main-scanning direction" of the above printer 14, a scanning direction in which ink is discharged during movement of a head or a recording medium will be also referred to as the main-scanning direction. Including the "sub-scanning direction" of the above printer 14, a scanning direction in which ink is not discharged during movement of a head or a recording medium and which is perpendicular to the main-scanning direction will also be referred to as the sub-scanning direction.

<Functional Configuration of Image Processing Apparatus 1>

Figure 1B:
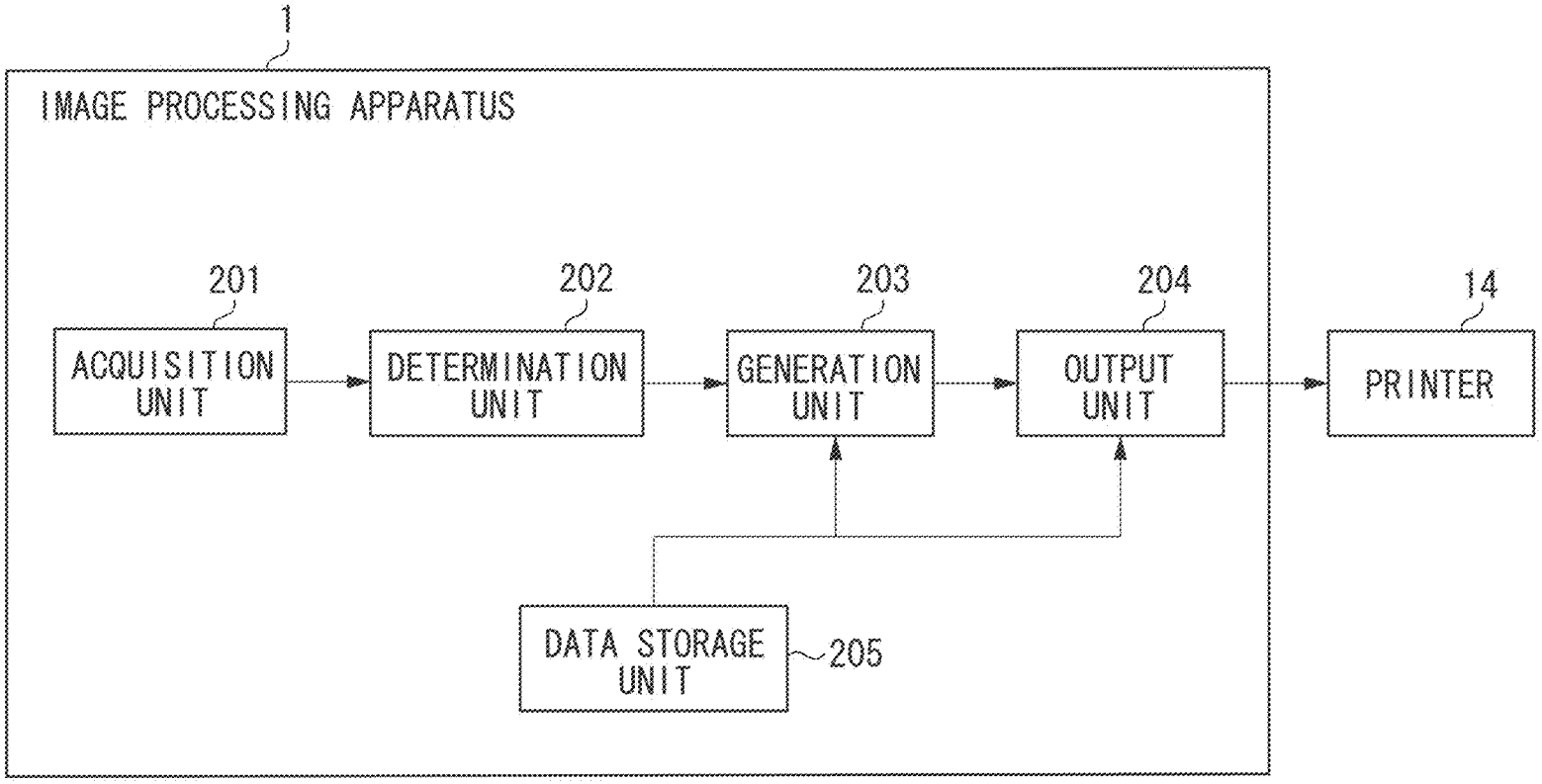

FIG. 1B is a block diagram illustrating a functional configuration of the image processing apparatus 1. Processing contents that image processing applications included in various programs described above execute based on instructions from the CPU 101 will be described with reference to FIG. 1B. The image processing apparatus 1 includes an acquisition unit 201, a determination unit 202, a generation unit 203, an output unit 204, and a data storage unit 205. The acquisition unit 201 acquires data specified via the general-purpose I/F 104 from the HDD 17 or a recording medium mounted on the general-purpose drive 18. The acquisition unit 201 in the first exemplary embodiment acquires image data that indicates an image to be formed on unevenness and shape data that indicates a shape of the unevenness to be formed on a recording medium. The image data in the first exemplary embodiment is data having color information per pixel. The shape data in the first exemplary embodiment is data having height information per pixel, to indicate a shape of the unevenness with a height distribution. By analyzing the shape data, the determination unit 202 determines a correction amount used for correcting the shape data. In the first exemplary embodiment, the generation unit 203 described below corrects the shape data so that the direction of the pattern of the shape indicated by the shape data matches the scanning direction of the head. To this end, the determination unit 202 determines the direction of the pattern of the unevenness having the shape indicated by the shape data and calculates, as a correction amount, a rotation angle for changing the determined direction of the pattern of the unevenness so that the direction of the pattern matches the scanning direction of the head. By correcting the shape data based on the correction amount, the generation unit 203 generates second shape data. Based on the image data and the second shape data, the output unit 204 generates dot arrangement data representing the dot arrangement of ink and outputs the generated dot arrangement data to the printer 14. When receiving the dot arrangement data, the printer 14 records ink on a recording medium based on the dot arrangement data. In this way, the unevenness (the uneven layer) and the image (the image layer) are overlapped. When the printer 14 receives data obtained by the above processing of the image processing apparatus 1, even when the printer 14 changes the pattern of the unevenness to be reproduced, the printer 14 forms the unevenness having the pattern in a predetermined direction (the scanning direction). The data storage unit 205 previously holds information such as device characteristics including the main-scanning direction of the printer 14. Specific processing and operations of various components will be described below.

<Flow of Processing by Image Processing Apparatus 1>

Figure 4A:
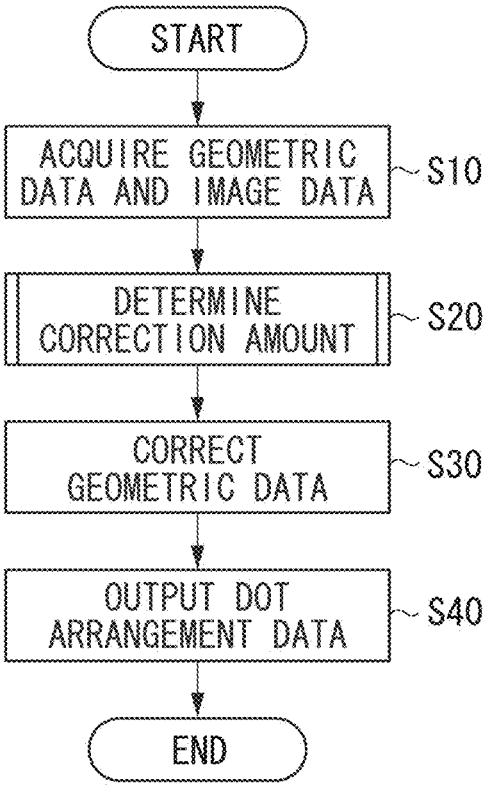
FIGS. 4A and 4B are flowcharts illustrating processing performed by the image processing apparatus.

FIG. 4A is a flowchart illustrating processing to be performed by the image processing apparatus 1. Next, the processing to be performed by the image processing apparatus 1 will be described in detail with reference to FIG. 4A. The CPU 101 performs the processing illustrated in the flowchart in FIG. 4A by loading a program code stored in the ROM 102 to the RAM 103. In addition, the processing illustrated in the flowchart in FIG. 4A is started when a user inputs an instruction by operating the input device 13 and the CPU 101 receives the input instruction. Hereinafter, each step will be denoted by a reference character having "S" at the beginning.

In step S10, the acquisition unit 201 acquires shape data and image data. The first exemplary embodiment assumes that the data is previously recorded in a predetermined storage device such as the HDD 17. The shape data represents a shape of the unevenness to be reproduced in the form of a height distribution (a height per position). More specifically, the shape data is data in which a pixel value indicating height information is recorded per pixel. The image data represents the image to be reproduced. More specifically, the image data is data in which a pixel value indicating color information is recorded per pixel. The shape data in the first exemplary embodiment is gray-scale image data in tagged image file format (TIFF) in which the height of each pixel is represented by an 8-bit value. The shape data is a data group in which a value from 0 to 2,000 μm that represents the height of an individual pixel from a reference surface has been normalized to an 8-bit (0-255) value. The reference surface in the first exemplary embodiment is a surface of a recording medium. The image data in the first exemplary embodiment is color image data in TIFF in which the color of each pixel is represented by an 8-bit value. The image data is three-channel image data, and the first exemplary embodiment assumes that R, G, and B values are recorded as the color information for each pixel.

To generate the shape data, for example, a stereo method may be used. In the stereo method, image data is captured by two digital cameras disposed side by side, and a shape of the unevenness is acquired from the image data based on the principle of triangulation. Alternatively, to generate the shape data, a user may design unevenness having a desired shape by using commercially available modeling software and render three-dimensional (3D) data representing the shape of the unevenness on a two-dimensional (2D) image data. Likewise, color image data corresponding to the above shape data may be generated by using digital cameras or commercially available software.

The format of the shape data is not limited to the above data format, as long as information for generating unevenness can be obtained. For example, the shape data may hold information about a relative height per pixel. In this case, the acquisition unit 201 converts an 8-bit (0-255) pixel value into a height in a desired range based on the maximum height specified by a user via the input device 13. In addition, as long as the shape data is data representing a height per pixel in the unevenness, data other than gray-scale image data may be used as the shape data. For example, point group data or polygon data described by a group of vertexes in a 3D space may be used. Alternatively, data representing a height distribution in a normal direction of the unevenness may be acquired and converted into the above shape data.

The format of the color image data is not limited to the above data format, as long as information for forming an image can be obtained. For example, the color image data may be ink amount data in which values indicating ink amounts (recording amounts) of the CMYK ink mounted on the printer 14 are recorded per pixel or image data in which a value indicating a CIEL*a*b* value is recorded per pixel.

Next, in step S20, the determination unit 202 determines a correction amount for correcting the shape data acquired in step S10. The correction amount in the first exemplary embodiment is a rotation angle θ of the height distribution of the shape data. The height distribution is rotated by the rotation angle θ so that the direction of the pattern of the unevenness to be reproduced matches the main-scanning direction in which the printer exhibits higher reproduction accuracy (responsiveness). The processing for determining the above correction amount will be described in detail below.

Next, in step S30, the generation unit 203 corrects the shape data acquired in step S10 based on the correction amount determined in step S20. The correction amount in the first exemplary embodiment is the rotation angle θ, as described above. In step S30, assuming that the top left portion of the height distribution of the shape data is the center coordinates (0, 0), a pixel value recorded at coordinates (x1, y1) is recorded at coordinates (x2, y2), which is obtained by rotating the coordinates (x1, y1) by the angle θ around the coordinates (0, 0). Through this processing, second shape data obtained by correcting the shape data is generated. For the transformation of the coordinates by the above rotation, 2D affine transformation illustrated by the following equations (1) is used. In equations (1), (cx, cy) are the center coordinates of the height distribution.

$$x2=(x1-cx)\times\cos\theta-(y1-cy)\times\sin\theta+cx$$

$$y2=(x1-cx)\times\sin\theta+(y1-cy)\times\cos\theta+cy \qquad \text{(equation 1)}$$

Figure 6:
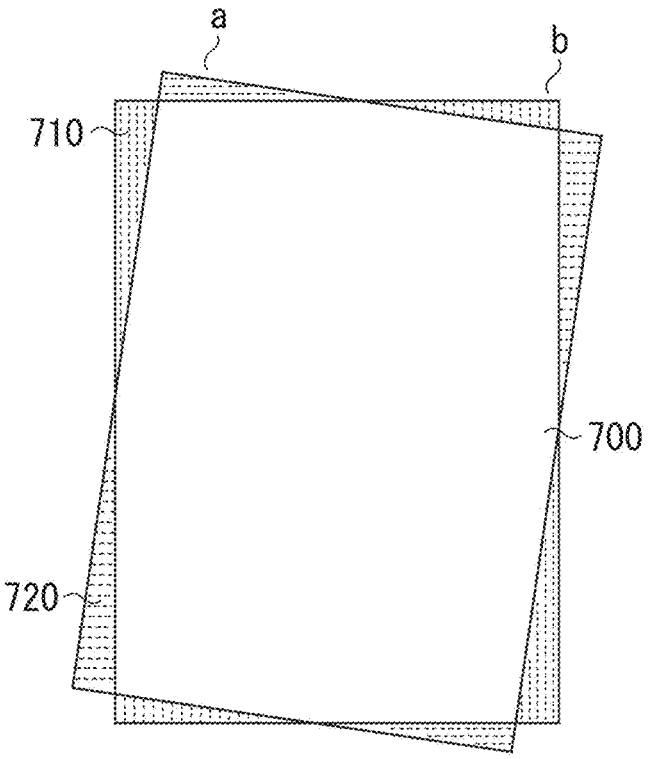
FIG. 6 illustrates processing performed by a generation unit.

Through the above rotation of the height distribution, mismatch between the direction of the pattern of the uneven layer and the direction of the pattern of the image layer occurs. In the first exemplary embodiment, the unevenness of an object in which the mismatch does not give viewers a strong feeling of strangeness about the printed product is used as the unevenness to be reproduced, and print processing in which higher priority is given to improvement of the reproduction accuracy of the unevenness over the mismatch is performed. FIG. 6 schematically illustrates an example of relative arrangement between an uneven layer formation area a and an image layer formation area b on a recording medium. As described above, the height distribution of the shape data has been rotated so that the direction of the pattern in the unevenness to be reproduced matches the main-scanning direction in which the printer achieves higher reproduction accuracy. An area 700 in FIG. 6 is an area in which the uneven layer and the image layer are superimposed. In the example in FIG. 6, because of the rotation of the height distribution, an area 710 in which the uneven layer is not formed and only the image layer is formed, and an area 720 in which the image layer is not formed and only the uneven layer is formed are created. After the above rotation of the height distribution, processing for changing pixel values may be separately applied to these areas 710 and 720. For example, a pixel value corresponding to height information 0 is recorded in the area of the height distribution corresponding to the area 720 of the uneven layer. In addition, regarding the area of the height distribution corresponding to the area 710 of the image layer, a pattern is generated by using, for example, a technique (an image inpainting technique) in which a texture (a pattern) included in the formation area b is extracted and a pattern similar to the extracted pattern is generated. Regarding the area of the color image corresponding to the area 710 of the image layer, an individual pixel value is set to 0 so as not to record colored ink.

The second shape data is generated by correcting the shape data in the first exemplary embodiment. However, as long as the same second shape data can be consequently obtained, the second shape data may be generated as new shape data, instead of generating the second shape data by correcting the shape data.

Next, in step S40, the output unit 204 generates dot arrangement data representing the dot arrangement of clear ink based on the second shape data generated by the generation unit 203. In addition, the output unit 204 generates dot arrangement data representing the dot arrangement of colored ink based on the image data acquired in step S10. The output unit 204 generates the dot arrangement data by performing known color separation and halftoning based on a conversion table or a conversion equation stored in the data storage unit 205. The dot arrangement data is binary data in which the dot arrangement of ink is represented by pixels on which ink is discharged (pixel value 1) and pixels on which ink is not discharged (pixel value 0). Finally, the output unit 204 outputs the dot arrangement data generated in step S40 to the printer 14 and ends the present processing. The output unit 204 may first generate dot arrangement data representing the dot arrangement per recording scanning (path) through known path separation and next output the generated dot arrangement data to the printer 14.

<Processing by Determination Unit 202>

Figure 4B:
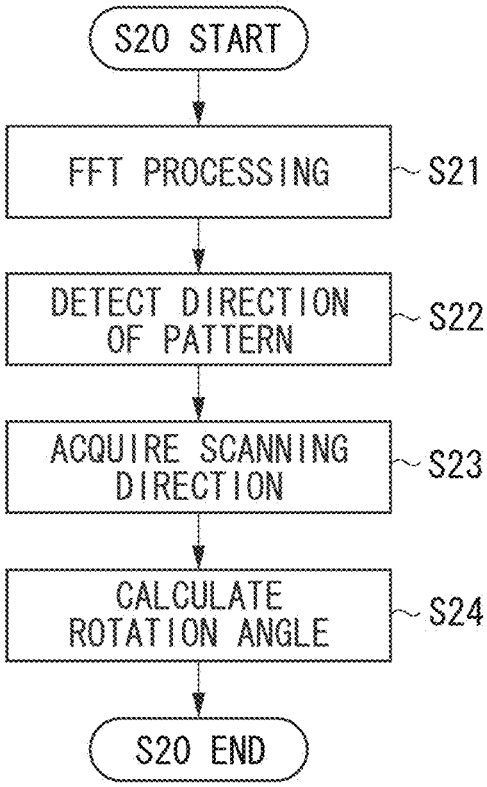
Figure 5A:
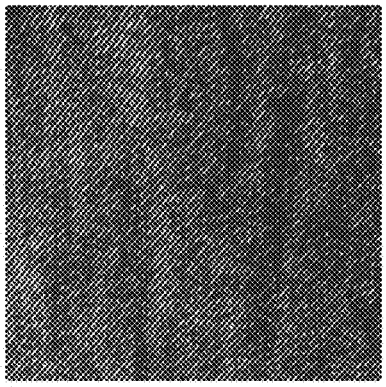
FIGS. 5A to 5D illustrate processing performed by a determination unit.
Figure 5B:
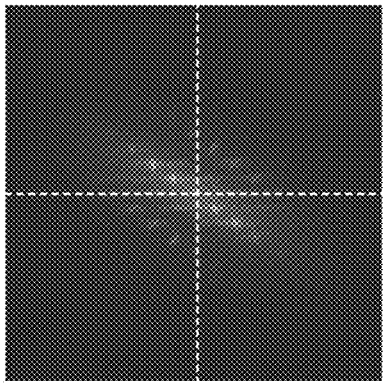

The processing (step S20) to be performed by the determination unit 202 will be described in detail with reference to FIG. 4B. The correction amount in the first exemplary embodiment is the rotation angle θ of the height distribution. FIGS. 5A and 5B illustrate an example of the shape data acquired in step S10 and an example of the shape data generated by the following processing. In FIGS. 5A and 5B, denim fabric is used as an example of the unevenness to be reproduced. FIG. 5A illustrates the shape data acquired in step S10, and fine unevenness of the fiber of the denim fabric can be perceived as the contrast of an individual pixel value.

First, in step S21, the determination unit 202 performs 2D fast Fourier transform (FFT) on the shape data illustrated in FIG. 5A and acquired in step S10. As a result, FFT image data representing spatial frequency characteristics of the unevenness to be reproduced is generated. FIG. 5B illustrates an example of the FFT image data generated by performing the FFT on the shape data illustrated in FIG. 5A in step S21. The FFT image data is data representing a 2D FFT image (a frequency image) obtained by the FFT, and the distance from the center on the FFT image represents a frequency. The direction of the fiber of the denim fabric (the pattern of the unevenness) appears as a power spectrum bias at an angle between 0° and 180° from the center on the FFT image data. These angles will be described assuming that the positive direction (the right direction) along the X axis from the center of the FFT image data corresponds to 0° and the positive direction (the upper direction) along the Y axis corresponds to 90°.

Figure 5C:
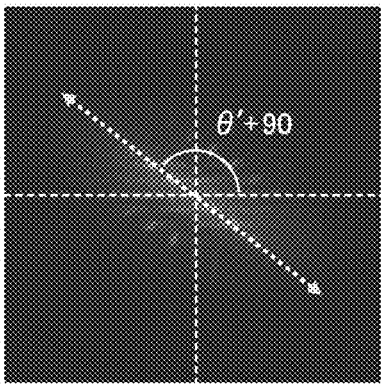

In step S22, the determination unit 202 detects a direction of a pattern of the unevenness having the shape indicated by the shape data. As described above, the direction of the pattern of the unevenness appears as a power spectrum bias at an angle between 0° and 180° from the center on the FFT image data generated in step S21. When the average value of pixel values at each angle between 0° and 180° from the center on the FFT image data is calculated, the angle corresponding to the maximum value (peak) of the calculated average values changes depending on the direction of the pattern of the unevenness. More specifically, when the unevenness having the shape indicated by the shape data has a pattern at an angle θ', if the FFT is performed on the shape data, the power spectrum in the direction corresponding to θ'+90° on the FFT image data obtained through the FFT is increased. In step S22, the determination unit 202 detects an angle from the center on the FFT image data, the angle corresponding to the maximum average value, and obtains the direction θ' of the pattern of the unevenness. A dashed line 601 in FIG. 5C schematically illustrates the detected peak direction θ'+90° on the FFT image data. The unevenness having the pattern in the direction in which the averaged power spectrum value on the FFT image data is large has such characteristics that a large area is occupied by the uneven layer or the amplitude is large, for example.

In step S23, the determination unit 202 acquires an angle θm corresponding to the main-scanning direction of the printer 14 used when a print product is formed. In the first exemplary embodiment, the X axis direction, i.e., the direction corresponding to 0° to 180°, is considered as the main-scanning direction.

Figure 5D:
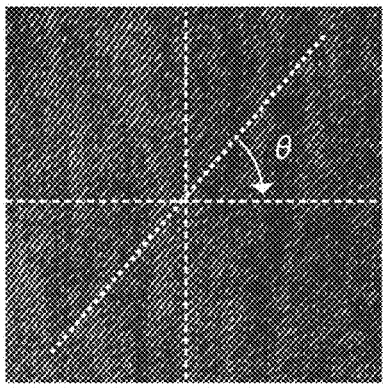
Figure 5D:
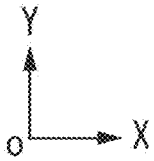

In step S24, the rotation angle θ of the height distribution of the shape data is determined. The rotation angle θ is obtained by calculating a difference value between the main-scanning direction em and the direction θ' of the pattern of the unevenness to be reproduced. The main-scanning direction em in the first exemplary embodiment corresponds to 0° and 180°, a difference value between 0° and θ' and a difference value between 180° and θ' are calculated. Next, a difference value θ'−θm corresponding to the smaller one of the absolute values of the difference values is set as the rotation angle θ. In this way, the difference between the height distribution before the rotation and the height distribution after the rotation can be minimized. A dashed line 602 in FIG. 5D schematically illustrates the calculated rotation angle θ on the shape data.

Effect by First Exemplary Embodiment

As described above, the image processing apparatus 1 according to the first exemplary embodiment acquires shape data representing a shape of the unevenness to be reproduced and determines a direction of a pattern of the unevenness to be reproduced. In addition, the image processing apparatus 1 determines the rotation angle for changing the direction of the pattern of the unevenness based on the scanning direction of the printer 14 for forming the unevenness to be reproduced on a recording medium. The image processing apparatus 1 generates second shape data representing a shape having a pattern in the scanning direction of the printer 14 based on the determined rotation angle. Through the above processing of the image processing apparatus 1, it is possible to form an uneven layer while causing the direction of the pattern of the evenness to be reproduced to match the main-scanning direction in which the reproduction accuracy of the printer 14 is high regarding the unevenness. Thus, it is possible to prevent deterioration of the reproduction accuracy based on the direction of the pattern of the unevenness and form the target unevenness on a recording medium.

Difference from First Exemplary Embodiment

In the first exemplary embodiment, the direction of the patter of the unevenness to be reproduced is detected, and the shape data is corrected so that the detected direction of the pattern matches the main-scanning direction. Next, a second exemplary embodiment will be described by using an example in which the shape data is divided into shape data formed by the high-frequency component of the unevenness and shape data formed by the low-frequency component of the unevenness and in which correction (rotation) processing is applied only to the shape data formed by the high-frequency component. In addition, in the first exemplary embodiment, the main-scanning direction is used as the direction in which the reproduction accuracy of the unevenness is high. As described above, the direction of the pattern of the unevenness matching the sub-scanning direction achieves higher reproduction accuracy regarding the unevenness than the direction of the pattern of the unevenness being a diagonal direction. Thus, in the second exemplary embodiment, an example in which the direction in which the reproduction accuracy of the unevenness is high is set to both the main- and sub-scanning directions and the direction of the pattern of the unevenness is adjusted to match the scanning direction corresponding to an angle θ at which the rotation angle of the height distribution is the minimum will be described. The functional configuration of the image processing apparatus 1 according to the second exemplary embodiment is the same as that according to the first exemplary embodiment, and the acquisition unit 201 to the data storage unit 205 perform the respective processes. Next, processing different from that according to the first exemplary embodiment will be mainly described.

<Flow of Processing by Image Processing Apparatus 1>

As in the first exemplary embodiment, in step S10, the acquisition unit 201 acquires shape data and image data. In addition, in the second exemplary embodiment, the high-frequency component of the unevenness to be reproduced is extracted by applying a high-pass filter to the shape data. In addition, the low-frequency component of the unevenness to be reproduced is extracted by applying a low-pass filter to the shape data. Hereinafter, the shape data formed by the high-frequency component obtained by performing the high-pass filter processing will be referred to as height data H, and the shape data formed by the low-frequency component obtained by performing the low-pass filter processing will be referred to as height data L.

In step S20, the determination unit 202 calculates the rotation angle θ, which is the correction amount of the shape data H. The processing and operation in step S20 will be described in detail below. Next, in step S30, the generation unit 203 rotates the height distribution on the shape data H by the rotation angle θ and adds the individual pixel values of the shape data H after the height distribution is rotated to the individual pixel values of the shape data L. As a result, second shape data is generated. Next, as in the first exemplary embodiment, in step S40, based on the image data and the second height data, the output unit 204 generates dot arrangement data corresponding to the dot arrangement of ink and outputs the generated dot arrangement data to the printer 14.

<Processing by Determination Unit 202>

Next, the processing (S20) to be performed by the determination unit 202 according to the second exemplary embodiment will be described in detail.

Figure 7A:
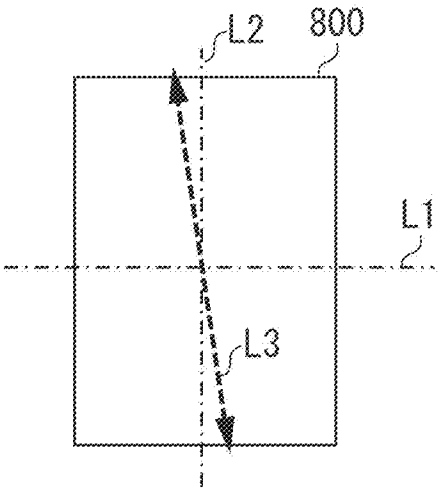
FIGS. 7A to 7C illustrate processing performed by the determination unit.
Figure 7B:
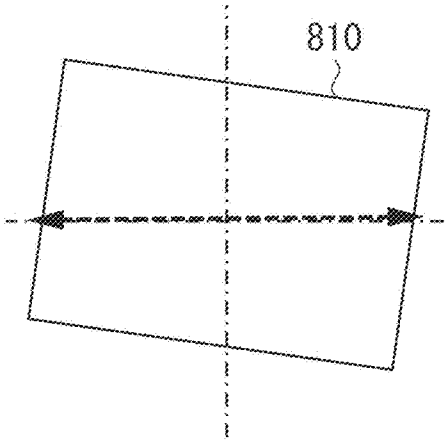
Figure 7C:
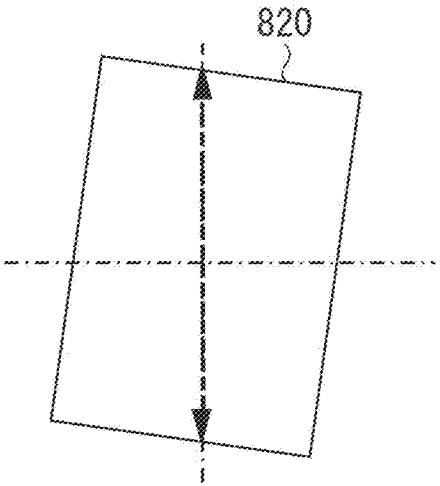

In step S21, as in the first exemplary embodiment, the determination unit 202 generates FFT image data H by performing FFT processing on the shape data H. Next, in step S22, as in the first exemplary embodiment, the determination unit 202 detects the direction θ' of the pattern of the unevenness having the shape represented by the shape data H based on the FFT image data H. Next, in step S23, the determination unit 202 acquires angles θm1 and θm2 corresponding to the main-scanning direction and the sub-scanning direction stored in advance in the data storage unit 205 as the directions in which the reproduction accuracy of the unevenness is high. Finally, in step S24, the determination unit 202 calculates a rotation angle that causes the direction θ' of the pattern of the unevenness to match the main-scanning direction θm1 and a rotation angle that causes the direction θ' of the pattern of the unevenness to match the sub-scanning direction θm2. The smaller rotation angle θ'−θm is used as the rotation angle θ. A concept of the rotation angle will be described by using schematic diagrams in FIGS. 7A to 7C. An area 800 in FIG. 7A represents an uneven layer, and lines L1 and L2 represent the main-scanning direction and the sub-scanning direction, respectively. In addition, a line L3 represents a direction of a pattern of the uneven layer 800. An area 810 in FIG. 7B represents the uneven layer that has been rotated so that the direction of the pattern of the uneven layer matches the main-scanning direction. An area 820 in FIG. 7C represents the uneven layer that has been rotated so that the direction of the pattern of the uneven layer matches the sub-scanning direction. Since the rotation angle for rotating the uneven layer 800 to the uneven layer 820 is smaller than the rotation angle for rotating the uneven layer 800 to the uneven layer 810, the determination unit 202 according to the second exemplary embodiment uses the former rotation angle as the rotation angle θ.

Effect by Second Exemplary Embodiment

As described above, in the second exemplary embodiment, the correction processing is not performed on the low-frequency component of unevenness whose pattern direction is easily perceived and which does not easily cause deterioration of the reproduction accuracy due to variation in the pattern direction. The correction processing is performed only on the high-frequency component of the unevenness. In this way, it is possible to reduce the difference between the unevenness to be reproduced and the unevenness formed on a recording medium while preventing deterioration of the reproduction accuracy of the high-frequency component of the unevenness whose reproduction accuracy is easily deteriorated. In addition, the direction of the pattern of the unevenness is adjusted to match the scanning direction corresponding to an angle at which the rotation angle of the height distribution in the correction processing is the minimum, between the main-scanning direction and the sub-scanning direction. As a result, the difference between the unevenness to be reproduced and the unevenness formed on a recording medium can be further reduced.

According to a third exemplary embodiment, information about the correction processing is presented to the user, and whether to apply the above correction processing to the shape data is determined based on input information representing an instruction from the user. In the third exemplary embodiment, processing different from that according to the first exemplary embodiment will be mainly described.

<Functional Configuration of Image Processing Apparatus 1>

Figure 9:
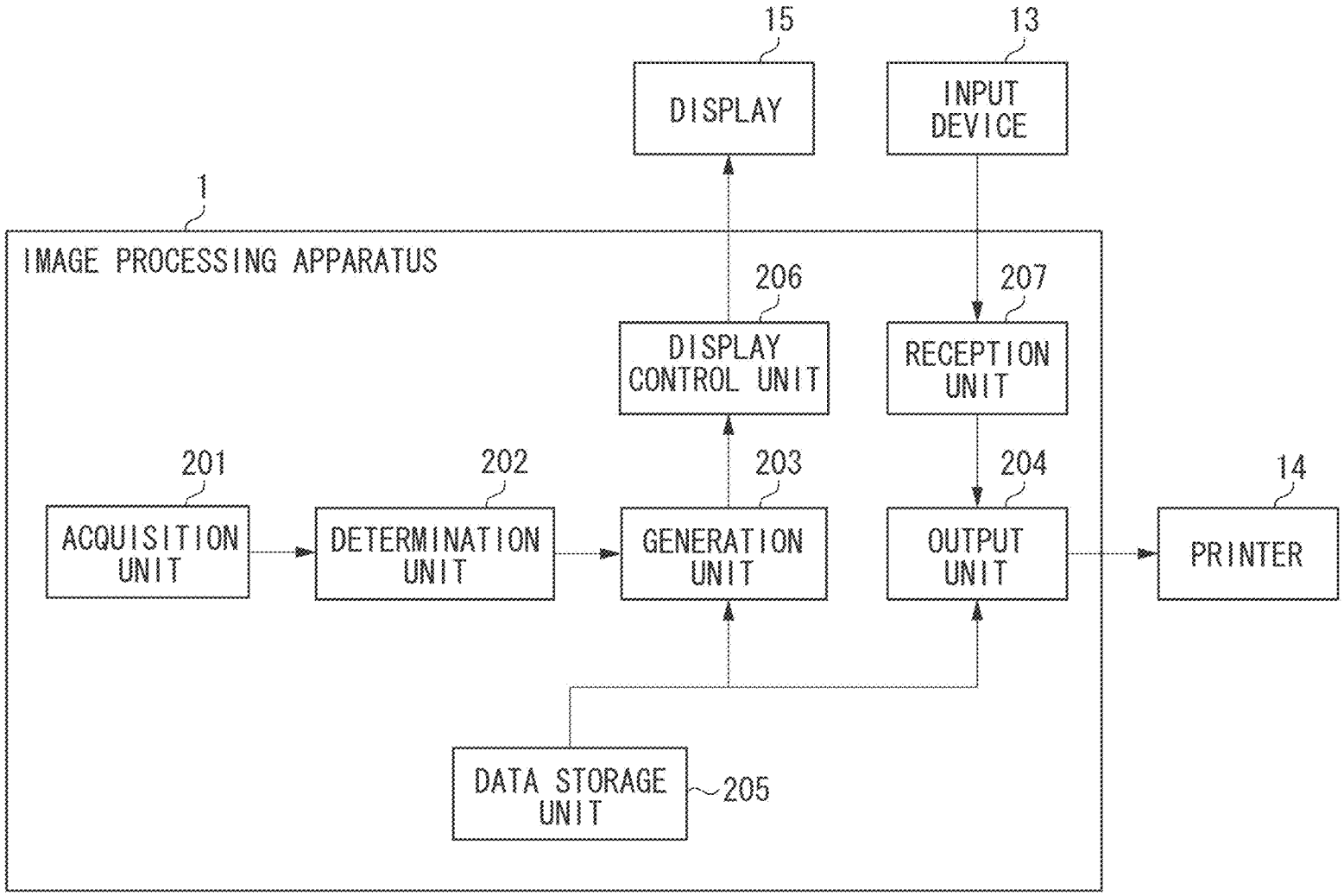
FIG. 9 is a block diagram illustrating a functional configuration of an image processing apparatus.

FIG. 9 is a block diagram illustrating a functional configuration of an image processing apparatus 1. As with the image processing apparatus 1 according to the first exemplary embodiment, the image processing apparatus 1 according to the third exemplary embodiment includes an acquisition unit 201, a determination unit 202, a generation unit 203, an output unit 204, and a data storage unit 205. In addition, the image processing apparatus 1 according to the third exemplary embodiment further includes a display control unit 206 and a reception unit 207. The acquisition unit 201 to the data storage unit 205 and the printer 14 are the same as those according to the first exemplary embodiment, and redundant description thereof will be avoided. The display control unit 206 displays, on a display 15, information such as a correction amount determined by the determination unit 202 and a UI for receiving user's instructions. The reception unit 207 receives input information representing user's instructions obtained via an input device 13. Processing and operations of these components will be described in detail below.

<Flow of Processing by Image Processing Apparatus 1>

Figure 10:
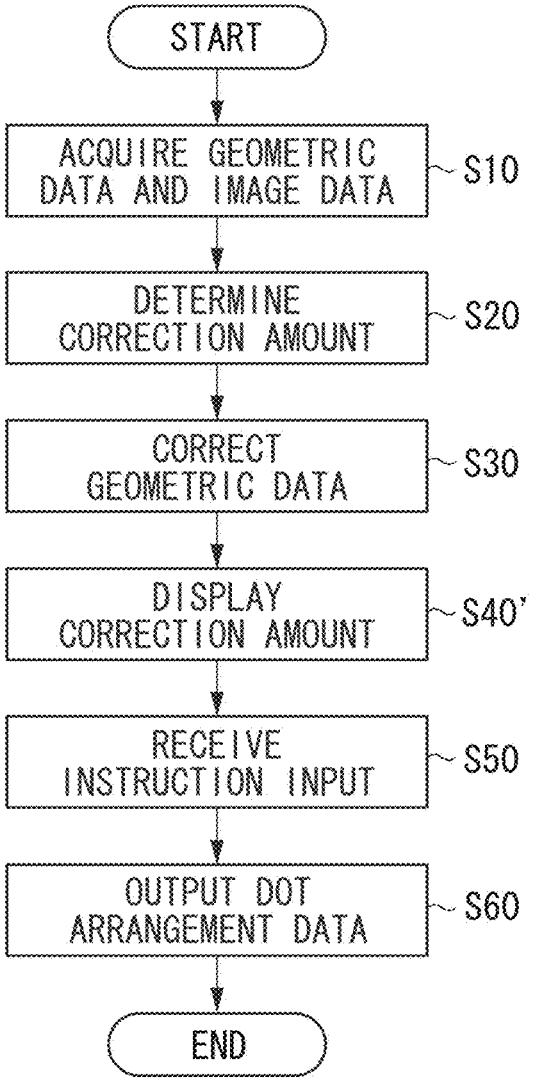
FIG. 10 is a flowchart illustrating processing performed by the image processing apparatus.

FIG. 10 is a flowchart illustrating processing to be performed by the image processing apparatus 1. Next, the processing performed by the image processing apparatus 1 will be described in detail with reference to FIG. 10. The CPU 101 performs the processing illustrated by the flowchart in FIG. 10 by loading a program code stored in the ROM 102 to the RAM 103. In addition, the processing illustrated by the flowchart in FIG. 10 is started when the CPU 101 receives input information representing a user's instruction.

In steps S10 to S30, as in the first exemplary embodiment, the acquisition unit 201, the determination unit 202, and the generation unit 203 acquire shape data and image data, determine a correction amount, and correct the shape data.

Figure 11B:
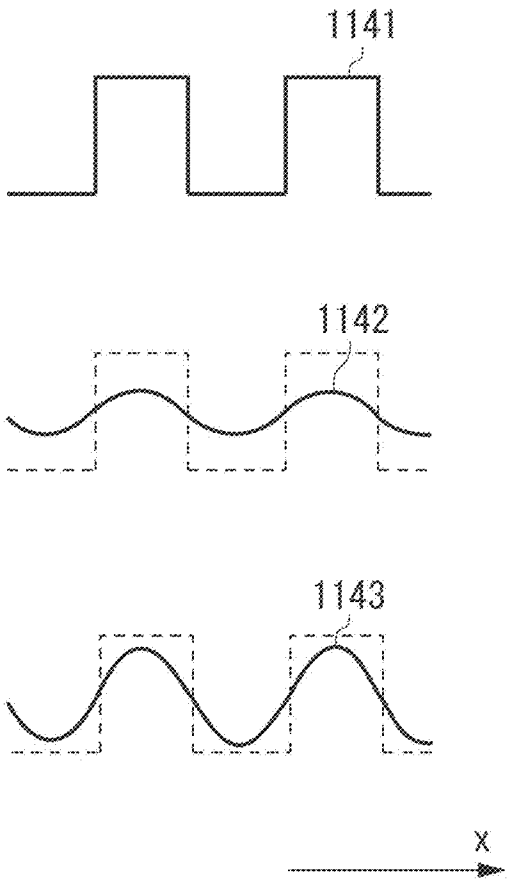
FIGS. 11A and 11B are an example of a user interface (UI) displayed by a display.
Figure 11A:
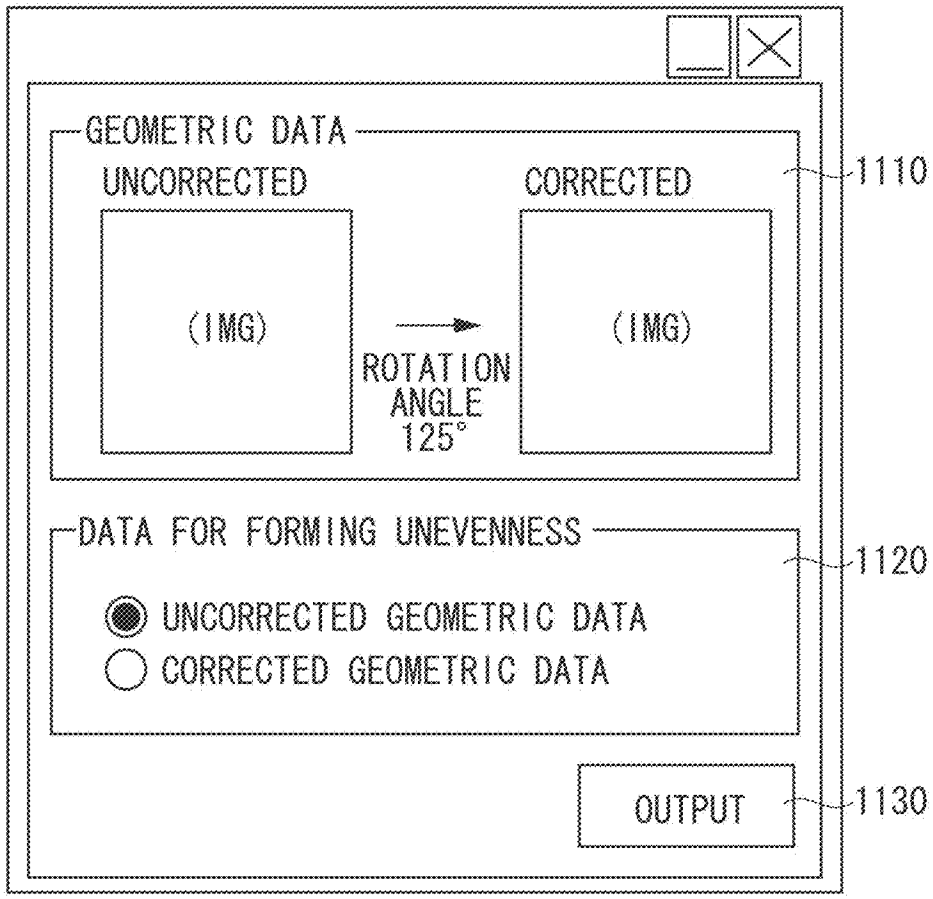

Next, in step S40', the display control unit 206 displays a UI for receiving input information specified by the user on the display 15. FIG. 11A illustrates an example of the UI according to the third exemplary embodiment. A display area 1110 displays information to be referred to by the user. More specifically, the display area 1110 displays the shape data (uncorrected shape data) acquired in step S10, the correction amount calculated in step S20, and the second shape data (corrected shape data) generated in step S30. Each of the shape data and the second shape data is displayed as a 2D image in which the height per pixel is recorded. The input area 1120 is an instruction input area in which the user specifies whether to apply the correction processing to the shape data. In other words, the input area 1120 is an instruction input area in which the user specifies whether to form the unevenness based on the shape data acquired in step S10 or based on the second shape data generated in step S30. When a button 1130 is pressed, the processing proceeds to step S50.

The information displayed in the display area 1110 is not limited to the above example. For example, a schematic diagram that qualitatively illustrates the effect obtained through the application of the correction processing may be displayed. FIG. 11B illustrates an example of the schematic diagram displayed in the display area 1110. A cross section 1141 is a cross section of a shape represented by shape data. A cross section 1142 is a cross section when the shape represented by the shape data is formed on a recording medium. A cross section 1143 is a cross section when the shape represented by the second shape data is formed on a recording medium. The example in FIG. 11B illustrates a cross section when the shape is cut in a direction orthogonal to the direction of the pattern of the unevenness. The cross sections 1142 and 1143 are estimated by referring to device characteristics (CTF) of the printer 14 previously stored in the data storage unit 205. More specifically, first, the CTF of the printer 14 corresponding to the direction θ' of the pattern of the unevenness represented by the shape data and a frequency f is acquired from the data storage unit 205, and the acquired CTF is set as a reference value. The frequency f is a frequency at which the Radially Averaged Power Spectrum (RAPS) calculated on the FFT image obtained by performing the FFT on the shape data is the maximum. The RAPS is an averaged power spectrum value at the same frequency on the FFT image. The direction θ' of the pattern corresponds to the angle calculated in accordance with the method in step S20. Next, smoothing processing is repeatedly performed on the cross section 1141 until the CTF matches a reference value. The smoothing processing signifies execution of moving average in the x axis direction in FIG. 11B. As described above, the CTF is a value obtained by dividing a measured value about the height difference between a concave portion and a convex portion by a theoretical value. In accordance with the above method, the cross section 1142 can be estimated. Likewise, as to the second shape data, the cross section 1143 is estimated by acquiring a reference value and performing smoothing processing. The smoothing processing may be performed until the difference between the CTF and a reference value reaches a predetermined threshold or less, instead of being performed until the CTF matches the reference value. In addition, the shape data and the second shape data may be displayed in the display area 1110 as shape in a 3D space, instead of as 2D images.

In step S50, the reception unit 207 receives information representing an instruction input by the user and selects one of the shape data and the second shape data based on the instruction. More specifically, when the reception unit 207 receives an instruction for application of the correction processing to the shape data, the reception unit 207 selects the second shape data generated in step S30 as the data (data for forming the unevenness) to be output to the output unit 204. When the reception unit 207 is instructed not to apply the correction processing to the shape data, the reception unit 207 selects the shape data that has not been corrected in step S30, as the data (data for forming the unevenness) to be output to the output unit 204.

Next, in step S60, the output unit 204 generates dot arrangement data representing the dot arrangement of clear ink based on the data selected in step S50. In addition, as in the first exemplary embodiment, the output unit 204 generates dot arrangement data representing the dot arrangement of colored ink based on the image data acquired in step S10. Finally, the output unit 204 outputs the dot arrangement data generated in step S60 to the printer 14 and ends the present processing.

Effect by Third Exemplary Embodiment

As described above, in the third exemplary embodiment, information about the correction processing is presented to the user via a UI, and whether to apply the correction processing to the shape data is determined based on input information representing a user's instruction. In addition, the effect obtained by the correction processing can be presented to the user. In addition, the uneven layer can be formed in view of the user's intention about whether to apply the correction processing.

Other Exemplary Embodiments

While only the shape data is corrected in the above exemplary embodiments, the correction processing including the rotation may also be performed on the color image data. For example, correction processing that is the same as that performed on the shape data may be performed. Alternatively, correction processing different from that performed on the shape data may be performed based on characteristics unique to the color image data, such as a direction of a texture pattern on an image represented by the color image data.

In the above exemplary embodiments, to detect the direction of the pattern of the unevenness, an averaged power spectrum value is calculated per angle from the center on the FFT image. However, a different representative value per angle may be calculated and used. For example, the frequency detection limit at which the observer cannot perceive may be stored in advance, and only an averaged power spectrum value within the detection limit may be calculated and used. Alternatively, only an averaged power spectrum value within the frequency range input by the user via a UI screen displayed on the display 15 may be calculated and used. Alternatively, a weighting coefficient may be set in advance per frequency, and a weighted average value using the weighting coefficient may be calculated and used.

In the above exemplary embodiments, an example in which an uneven layer and an image layer are formed by adopting an ink jet method has been described. However, a different recording method such as an electrophotographic method may be alternatively used.

In the above exemplary embodiments, an example in which an image layer is formed on an uneven layer has been described. However, before an uneven layer is formed, an image layer may be formed on a recording medium, and an uneven layer may be formed on the image layer. In addition, the number of layers to be formed is not limited to 2, which corresponds to an uneven layer and an image layer. For example, a glossy layer for controlling the gloss may be formed as an upper layer, a lower layer, or an intermediate layer.

In the above exemplary embodiments, an uneven layer is formed by using clear ink. However, an uneven layer may be formed by using colored ink such as CMYK. An uneven layer and an image layer may be formed by using ink other than UV-curable ink. For example, A recording material that cures when exposed to light other than UV light or when exposed to heat may be used.

In the above exemplary embodiments, an example has been described in which the output unit 204 outputs the dot arrangement data to the printer 14. However, the second shape data may be directly output to an external apparatus without performing halftoning and the like.

In the above exemplary embodiments, the image processing apparatus 1 is connected to the printer 14 via the serial bus 12. However, the printer 14 may be configured to include the image processing apparatus 1.

In the above exemplary embodiments, an example in which the processing is applied to the entire height distribution on the shape data has been described. However, the processing may be applied only to a part of the height distribution. For example, by generating mask data for indicating an area to which the processing is applied and an area to which the processing is not applied or by acquiring such mask data from the outside, the user can determine whether to apply the processing per area. In addition, the height distribution may be divided into blocks each of which is formed by a plurality of pixels, and the processing may be applied per block. In addition, different correction processing may be applied per block. For example, by applying the calculation of a correction amount in the second exemplary embodiment to each block, correction processing in which a correction amount differs per block can be performed.

Figure 8:
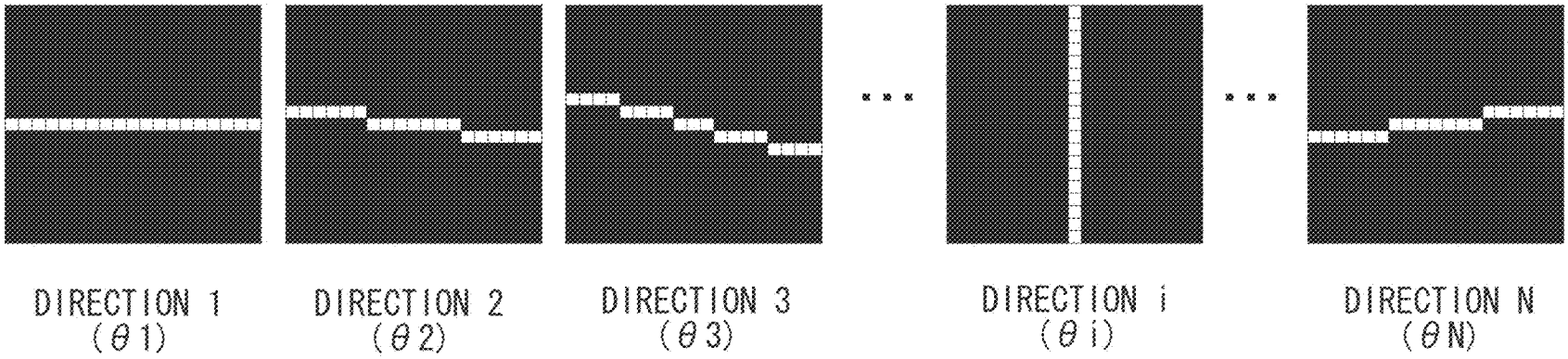
FIG. 8 illustrates an example of a method for determining a rotation angle.

In the above exemplary embodiments, the determination unit 202 determines the rotation angle, which is the correction amount, by using a frequency image. However, the rotation angle determination method is not limited to the above example. For example, the rotation angle may be determined in accordance with the following processing procedure. First, known filter processing using a Laplacian filter or the like is performed on the shape data, to detect edges. Next, filter processing is performed again on the shape data on which the filter processing has been performed, by using a group of filters 1 to N corresponding to angles θ illustrated in FIG. 8. Each of the filters 1 to N is used for calculating an average value of pixels in a corresponding white mask area in FIG. 8. When a filter in which an edge direction and a mask area direction match is applied, the largest value is calculated. Finally, the average values of all pixels in the shape data after application of each filter are calculated, and the direction of the filter corresponding to the shape data representing the largest average value that has been calculated is used as the rotation angle.

In the above exemplary embodiment, the determination unit 202 determines a single direction of a pattern of the unevenness to be reproduced. However, the pattern determination method is not limited to the example. For example, the determination unit 202 may determine a plurality of pattern directions of the unevenness to be reproduced, and the user may be allowed to input information indicating which one of the pattern directions is to match the scanning direction via a UI screen displayed on the display 15. In this case, for example, the directions in which the averaged power spectrum value is the largest, the second largest, and the third largest on the frequency image as described above may be displayed as candidates on the UI screen. The determination unit 202 determines the rotation angle based on information input by the user.

In the above exemplary embodiments, a printer whose main-scanning direction is the direction achieving the highest reproduction accuracy and whose sub-scanning direction is the direction achieving the second highest reproduction accuracy is used. However, the exemplary embodiments are not limited to the example. As described above, the reproduction accuracy of the printer regarding the unevenness varies depending on the control procedure for forming the unevenness, the accuracy in controlling parts, or image processing such as rasterization. Thus, the CTF of an individual unevenness having a parallel line pattern in an individual direction on a recording medium is measured, and the direction of the pattern of the unevenness achieving the highest CTF is stored in advance as device characteristics in the data storage unit 205. The rotation angle may be determined based on the device characteristics.

The unevenness to be reproduced according to the above exemplary embodiments is fine unevenness of the fiber of the denim fabric. The unevenness to be reproduced is not limited to the example. For example, the unevenness to be reproduced may be fine unevenness (wood grain) formed by conducting pipes of wood or unevenness of a surface of plastic formed by injection molding.

According to the aspect of the embodiments, target unevenness can be formed on a recording medium.

Other Embodiments

Embodiment(s) of the disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)), a flash memory device, a memory card, and the like.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Applications No. 2017-125069, filed Jun. 27, 2017, and No. 2018-042442, filed Mar. 8, 2018, which are hereby incorporated by reference herein in their entirety.

What is claimed is:

1. An apparatus which generates data for an inkjet printer that includes a head having an ink discharge port to form ink unevenness on a recording medium based on relative movement between the head and the recording medium and ink discharge by the head, the apparatus comprising:

one or more processors; and one or more memories coupled to the one or more processors, the one or more memories having instructions that, when executed by the one or more processors, perform operations as:

an acquisition unit configured to acquire first shape data representing a shape of the ink unevenness;

a first determination unit configured to determine a direction of a pattern of the ink unevenness based on the first shape data;

a second determination unit configured to determine a rotation angle for changing the direction of the pattern of the ink unevenness based on at least one of a movement direction of the head and a movement direction of the recording medium; and a generation unit configured to generate second shape data representing a shape having a pattern in at least one of the movement direction of the head and the movement direction of the recording medium based on the first shape data and the rotation angle.

2. The apparatus according to claim 1, wherein the second determination unit determines the rotation angle for causing the direction of the pattern of the ink unevenness to match at least one of the movement direction of the head and the movement direction of the recording medium.

3. The apparatus according to claim 1, wherein the generation unit generates the second shape data by correcting the first shape data based on the rotation angle.

4. The apparatus according to claim 3, wherein, in the first shape data, the shape of the ink unevenness is represented by a height distribution representing a height per position in the ink unevenness.

5. The apparatus according to claim 4, wherein the generation unit corrects the first shape data by rotating the height distribution so that the direction of the pattern matches at least one of the directions.

6. The apparatus according to claim 4, wherein at least one of the directions includes at least one of a first scanning direction in which the head discharges ink during the relative movement and a second scanning direction in which the head does not discharge ink during the relative movement.

7. The apparatus according to claim 6, wherein the second determination unit determines at least one of the directions to be the first or second scanning direction.

8. The apparatus according to claim 7, wherein, when the height distribution is rotated in the first and the second scanning directions, the second determination unit determines which one of the patterns is less changed after the rotation and determines the direction of the pattern that causes the smaller change to be at least one of the directions.

9. The apparatus according to claim 3, wherein the inkjet printer is a printer that overlaps the ink unevenness formed by clear ink and an image layer formed by colored ink on the recording medium, wherein the acquisition unit further acquires image data representing a color per position in the image layer, wherein the generation unit performs, on the image data, correction that is the same as that performed on the first shape data, and wherein the apparatus further comprises an output unit configured to generate ink amount data, which represents a recording amount of ink included in the inkjet printer, by using a conversion table that retains a correspondence between the recording amount of ink and the shape data, or dot arrangement data, which corresponds to dot arrangement on the recording medium, of ink included in the inkjet printer, by halftoning or path separation, based on the second shape data and the corrected image data, and output the ink amount data or the dot arrangement data to the inkjet printer.

10. The apparatus according to claim 1, wherein the first determination unit determines the direction of the pattern from a spatial frequency of the ink unevenness calculated based on the first shape data.

11. The apparatus according to claim 10, wherein the first determination unit calculates the spatial frequency by performing Fourier transform (FT) processing on the first shape data.

12. The apparatus according to claim 11, wherein the first determination unit refers to an image indicating the spatial frequency obtained by performing the FFT processing on the first shape data, calculates an averaged power spectrum value per angle from a center of the image, and determines a direction at an angle corresponding to a maximum averaged value among the averaged values to be the direction of the pattern.

13. The apparatus according to claim 1, wherein the second determination unit extracts a high-frequency component and a low-frequency component of the ink unevenness from the first shape data and determines the direction of the pattern of the high-frequency component, and wherein the generation unit corrects the high-frequency component so that the direction of the pattern of the high-frequency component matches at least one of the directions and generates the second shape data by adding up the high- and low-frequency components.

14. The apparatus according to claim 1, wherein the relative movement is movement that occurs when the inkjet printer moves the head with respect to the recording medium.

15. The apparatus according to claim 1, wherein the relative movement is movement that occurs when the inkjet printer moves the recording medium with respect to the head.

16. The apparatus according to claim 1, further comprising an output unit configured to generate ink amount data, which represents a recording amount of ink included in the inkjet printer, by using a conversion table that retains a correspondence between the recording amount of ink and the shape data, or dot arrangement data, which corresponds to dot arrangement on the recording medium, of ink included in the inkjet printer, by halftoning or path separation, based on either the first shape data or the second shape data, and output the ink amount data or the dot arrangement data to the inkjet printer.

17. The apparatus according to claim 16, further comprising:

a reception unit configured to receive an instruction from a user, the instruction indicating whether which one of the first shape data and the second shape data is to be used to generate the ink amount data or the dot arrangement data, wherein the output unit selects data used for generating the ink amount data or the dot arrangement data based on the instruction.

18. A printer which includes a head having an ink discharge port and forms ink unevenness on a recording medium based on relative movement between the head and the recording medium and ink discharge by the head, the printer comprising:

one or more processors; and one or more memories coupled to the one or more processors, the one or more memories having instructions that, when executed by the one or more processors, perform operations as:

an acquisition unit configured to acquire first shape data representing a shape of the ink unevenness; and a control unit configured to control forming, on the recording medium, ink unevenness having a pattern in at least one of a movement direction of the head and a movement direction of the recording medium based on the first shape data.

19. A method for generating data for an inkjet printer that includes a head having an ink discharge port to form ink unevenness on a recording medium based on relative movement between the head and the recording medium and ink discharge by the head, the image processing method comprising:

acquiring first shape data representing a shape of the ink unevenness;

determining a direction of a pattern of the ink unevenness based on the first shape data;

determining a rotation angle for changing the direction of the pattern of the ink unevenness based on at least one of a movement direction of the head and a movement direction of the recording medium; and generating second shape data representing a shape having a pattern in at least one of the movement direction of the head and the movement direction of the recording medium based on the first shape data and the rotation angle, wherein the image processing method is executed by one or more processors of the image processing apparatus based on instructions stored in one or more memories of the image processing apparatus.

20. A non-transitory computer-readable storage medium storing instructions that, when executed by a computer, cause the computer to perform a method for generating data for an inkjet printer that includes a head having an ink discharge port to form ink unevenness on a recording medium based on relative movement between the head and the recording medium and ink discharge by the head, the method comprising:

acquiring first shape data representing a shape of the ink unevenness;

determining a direction of a pattern of the ink unevenness based on the first shape data;

determining a rotation angle for changing the direction of the pattern of the ink unevenness based on at least one of a movement direction of the head and a movement direction of the recording medium; and generating second shape data representing a shape having a pattern in at least one of the movement direction of the head and the movement direction of the recording medium based on the first shape data and the rotation angle, wherein the image processing method is executed by one or more processors of the image processing apparatus based on instructions stored in one or more memories of the image processing apparatus.

* * * * *